US006216936B1

(12) United States Patent
Abe

(10) Patent No.: US 6,216,936 B1
(45) Date of Patent: Apr. 17, 2001

(54) COVER MECHANISM IN CARTRIDGE FOR ELECTRIC STAPLER

(75) Inventor: Shinya Abe, Tokyo (JP)

(73) Assignee: Max Co., Ltd., Tokyo (JP)

( * ) Notice: Subject to any disclaimer, the term of this patent is extended or adjusted under 35 U.S.C. 154(b) by 0 days.

(21) Appl. No.: 09/671,597

(22) Filed: Sep. 28, 2000

(30) Foreign Application Priority Data

Sep. 30, 1999 (JP) ..... 11-280411

(51) Int. Cl.[7] ..... B27F 7/21
(52) U.S. Cl. ..... 227/131; 227/120; 227/136
(58) Field of Search ..... 227/120, 131, 227/136, 135, 156; 206/340

(56) References Cited

U.S. PATENT DOCUMENTS 4,573,625 * 3/1986 Olesen et al. ..... 227/131
5,474,222 * 12/1995 Kanai et al. ..... 227/120
5,560,529 * 10/1996 Udagawa et al. ..... 227/136
5,676,299 * 10/1997 Yoshie et al. ..... 227/120
5,823,415 * 10/1998 Udagawa et al. ..... 227/131
6,039,230 * 3/2000 Yagi et al. ..... 227/131

FOREIGN PATENT DOCUMENTS 7-148674 6/1995 (JP) .

* cited by examiner

*Primary Examiner*—Scott A. Smith
(74) *Attorney, Agent, or Firm*—Morgan, Lewis & Bockius LLP

(57) ABSTRACT

A cover mechanism in a cartridge for an electric stapler comprises a movable wall, a cover body, and securing mechanism. The cartridge includes a storage portion for storing piled-up sheet-like staples each having linear-shaped staples connected together in a sheet shape. The movable wall is formed on a side wall of the storage portion and capable of swinging inwardly and outwardly. The cover body is disposed over an opening of the storage portion for insertion of the sheet-like staples and includes a covering portion. The covering portion of the cover body covers an outside portion of the movable wall and is respectively formed on two sides of the cover body. The securing mechanism secures together the covering portion of the cover body and the movable wall. Secured state between the covering portion of the cover body and the movable wall is removed when any sheet-like staples do not remain within the storage portion.

10 Claims, 5 Drawing Sheets

COVER MECHANISM IN CARTRIDGE FOR ELECTRIC STAPLER

BACKGROUND OF THE INVENTION

1. Field of the Invention

The present invention relates to a cover and a cover mechanism for use in a cartridge for an electric stapler, in which a cover body is mounted over the cartridge to be removably mounted into the electric stapler and the cover body cannot be opened before sheet-like staples stored in the cartridge are all consumed up.

2. Description of the Related Art

Generally, in a cartridge for an electric stapler, there is formed a storage portion capable of receiving and storing therein a refill (a component formed in such a shape as shown in FIG. 1 of JP-A-7-148674, which is also referred to as an inner cartridge) in which sheet-like staples each composed of a plurality of linear-shaped staples connected together in a sheet manner are piled up on top of another and are packed simply. In the upper portion (or lower portion) of the storage portion, there is formed an opening and thus the refill can be inserted into the storage portion of the cartridge through this opening. When the cartridge is mounted into the main body of the electric stapler with the present opening facing upwardly (or downwardly), the sheet-like staples are supplied sequentially in order starting at the nearest one to the opening from the storage portion to a drive portion of the cartridge, where the staples can be driven into a member to be stitched.

As shown in FIG. 5, in case where an operator removes a cartridge when one or more sheet-like staples 21 still remain within a storage portion 20 and, under an illusion that no sheet-like staple 21 remains within a refill 22, the operator opens a cover 23 to try to pull out the refill 22 from an opening formed in the cartridge in order to replace the refill 22 with a new one, since the refill 22 is structured such that it can be removed from the cartridge only after the sheet-like staples 21 are all consumed up, if the operator tries to pull out the refill 22 forcibly, then the refill 22 itself can be damaged or the sheet-like staples 21 may be broken. In this state, even if the operator gives up removing the refill 22, inserts it again into the main body of an electric stapler, and tries to drive the staples, because the refill or sheet-like staples are damaged and deformed, there is a fear that a feedmechanism fails to operate properly, which results in the poor feeding of the sheet-like staples.

SUMMARY OF THE INVENTION

The present invention aims at solving the abovementioned problems. Accordingly, it is an object of the invention to provide a cover mechanism for use in a cartridge for an electric stapler, in which a cover body is mounted over an opening formed in the cartridge and is structured such that it can be opened only after sheet-like staples are all consumed up, thereby being able to prevent the wrong replacement timing of a refill.

In attaining the above object, according to the invention, there is provided a cover mechanism for use in a cartridge for an electric stapler including a storage portion capable of storing therein piled-up sheet-like staples each including linear-shaped staples connected together in a sheet shape. At least a portion of the upper side walls of the storage portion is formed as movable walls capable of swinging inwardly and outwardly. A cover body is disposed over an opening formed at the upper end of the storage portion for insertion of the sheet-like staples, and covering portions for covering the outside portions of the movable walls are respectively formed on the two sides of the cover body. Further, there are disposed securing mechanism for securing together the covering portions of the cover body and the movable walls. The secured state between the covering portions of the cover body and the movable walls can be removed only when the movable walls are fallen down inwardly of the storage portion because any of the sheet-like staples does not remain within the storage portion.

BRIEF DESCRIPTION OF THE DRAWINGS

FIG. 2(*b*) is an explanatory view of the operation of a cartridge mechanism;

DETAILED DESCRIPTION OF THE PREFERRED EMBODIMENTS

Figure 1:
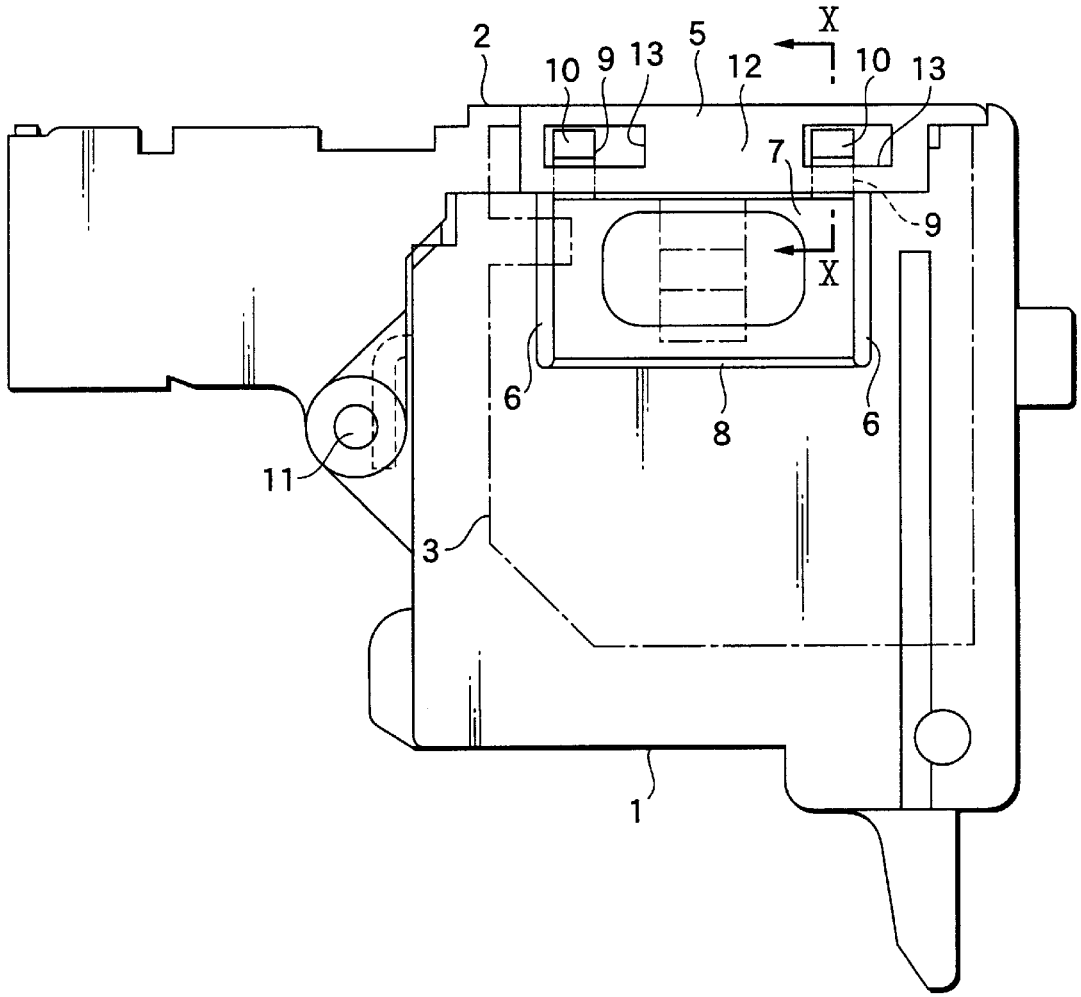
FIG. 1 is a side view of a cartridge according to the invention.
Figure 2A:
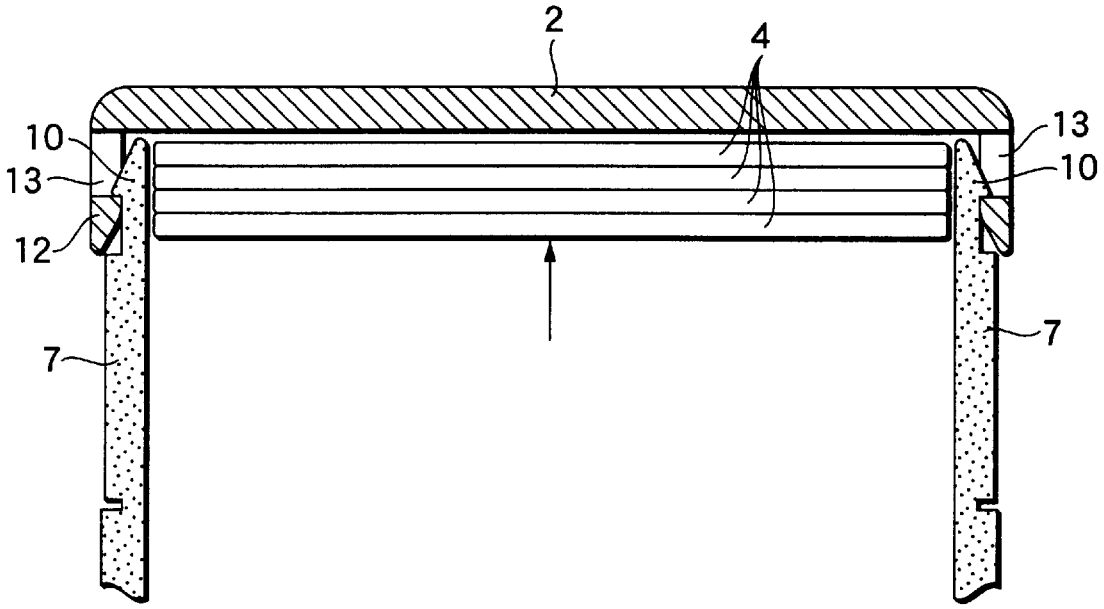
FIG. 2(*a*) is a section view taken along the X—X line shown in FIG. 1.
Figure 2B:
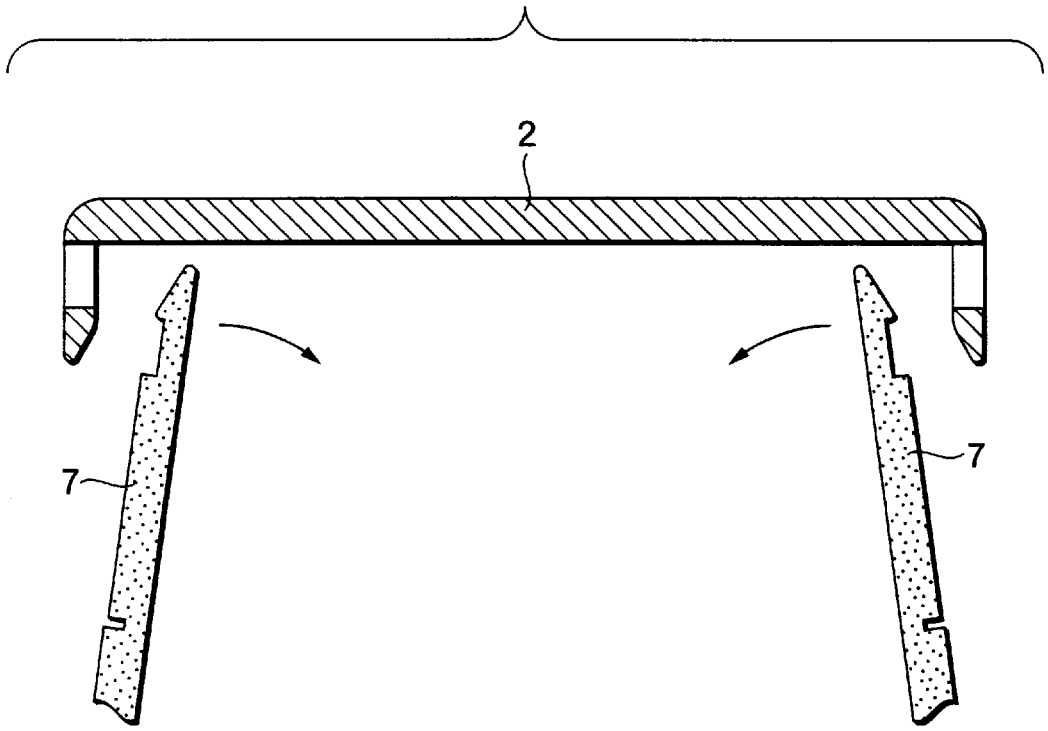

Now, FIG. 1 is a side view of a cartridge for an electric stapler; and, FIG. 2(*a*) is a section view taken along the line X—X shown in FIG. 1, and FIG. 2(*b*) is an explanatory view of the operation of a cover mechanism according to the invention. The present cartridge is composed of a storage portion 1 for storing staples therein and a cover body 2 which is connected to the storage portion 1 in such a manner that it can be rotated around a rotary shaft with respect to the storage portion 1 to thereby be able to open and close the storage portion 1.

In the staple storage portion 1, there is stored a refill 3. The refill 3, as described above and also as shown in detail in FIG. 3 (which will be discussed later), can be obtained by piling up sheet-like staples 4 on top of another, each of which is composed of linear-shaped staples connected together in a sheet shape, and then packing them simply; and, the refill 3 can be stored into the storage portion 1 from an opening 5 formed in the upper end of the storage portion 1. The sheet-like staples 4 of the refill 3 stored in the storage portion 1 are normally energized upward by a spring.

In the upper side walls of the storage portion 1, there are formed vertical slits 6 which are arranged in parallel to each other; and, in the inner side of these vertical slits 6, there are disposed movable walls 7 respectively and, the lower end portions 8 of the movable walls 7 are rotatably connected to the storage portion 1. For example, the storage portion 1 may be formed of synthetic resin, and the lower end portions 8 of the movable walls 7 may be molded as thin hinges integral with the storage portion 1. From the two sides of each movable wall 7, there are two projected engaging pieces 9 and, on the leading ends of the respective engaging pieces 9, there are respectively disposed engaging jaws 10 (see FIG. 2(*a*)).

Figure 3:
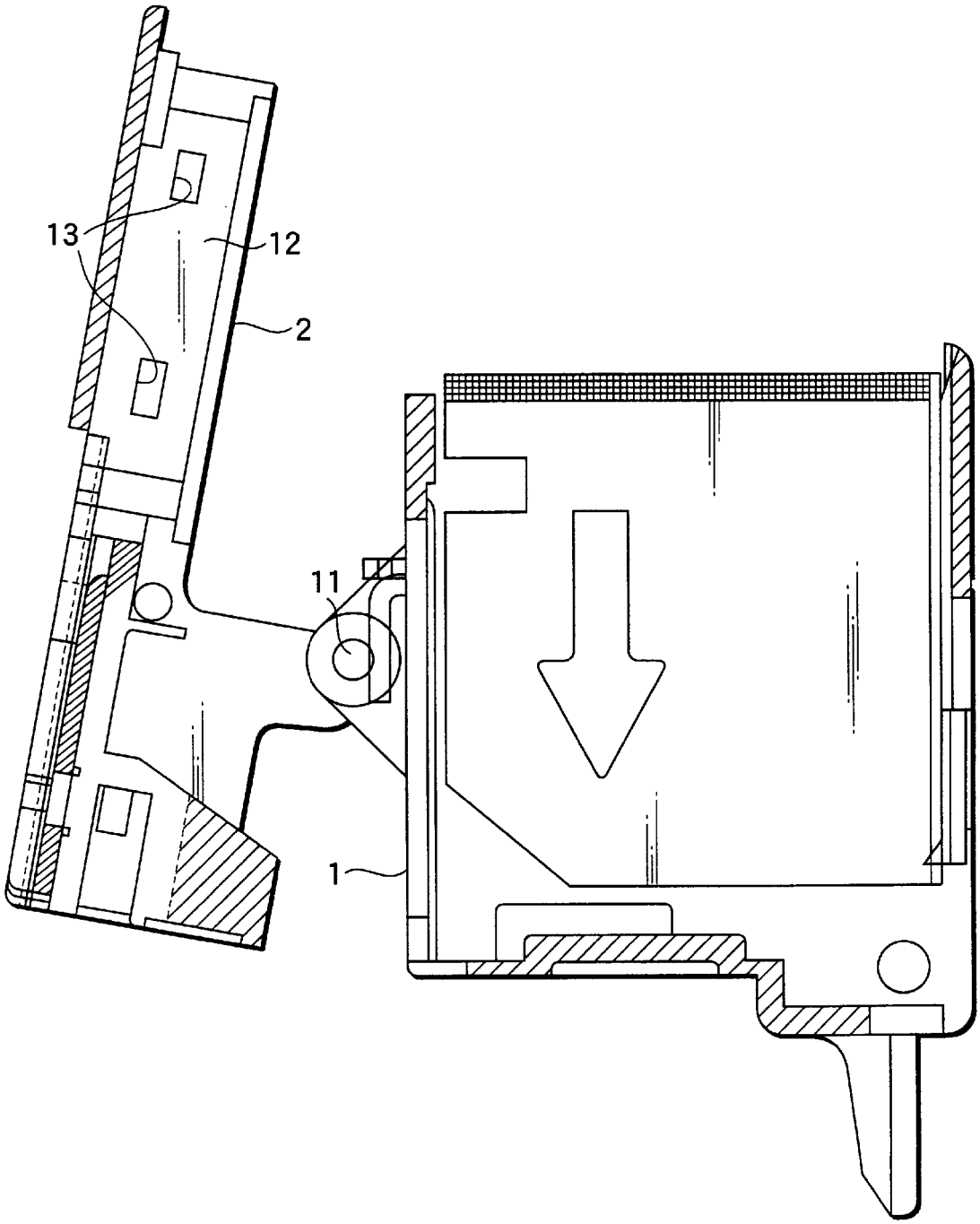
FIG. 3 is a section view of a cartridge, showing a state thereof in which a cover body is opened.

The cover body 2 is removably mounted on the upper portion of the above-mentioned cartridge. The cover body 2, as shown in FIG. 3, can be rotated around a rotary shaft 11 disposed in the front portion of the storage portion 1 to thereby be able to open and close the storage portion 1. When the cover body 2 is closed in such a manner as shown in FIG. 4, the cover body 2 covers the upper end opening of the storage portion 1 and the two sides of the storage portion 1; and, the portions of the cover body for covering the two sides of the storage portion 1 are formed as covering portions 12 which are used to cover the outside portions (mainly the engaging pieces 9) of the movable walls 7.

As shown in FIG. 2(*a*), in the covering portions 12 of the cover body 2, there are formed securing openings 13 respectively; and, when mounting the cover body 2 onto the cartridge, the securing openings 13 are secured to the securing jaws 10 of the movable walls 7 respectively. Accordingly, the securing openings 13 and securing jaws 10 cooperate together in forming securing mechanism.

Figure 4:
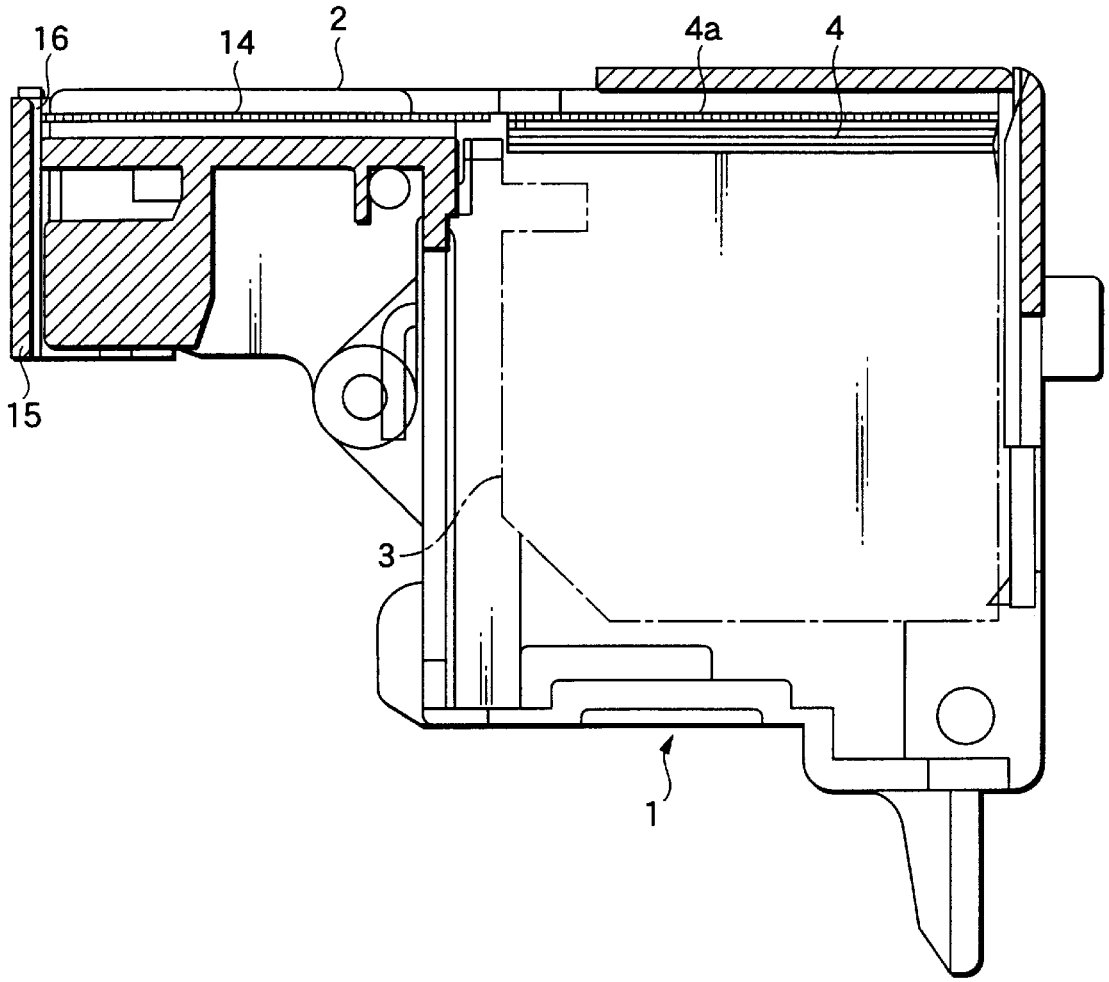
FIG. 4 is a section view of a cartridge, showing a state thereof in which a cover body is closed.
Figure 5:
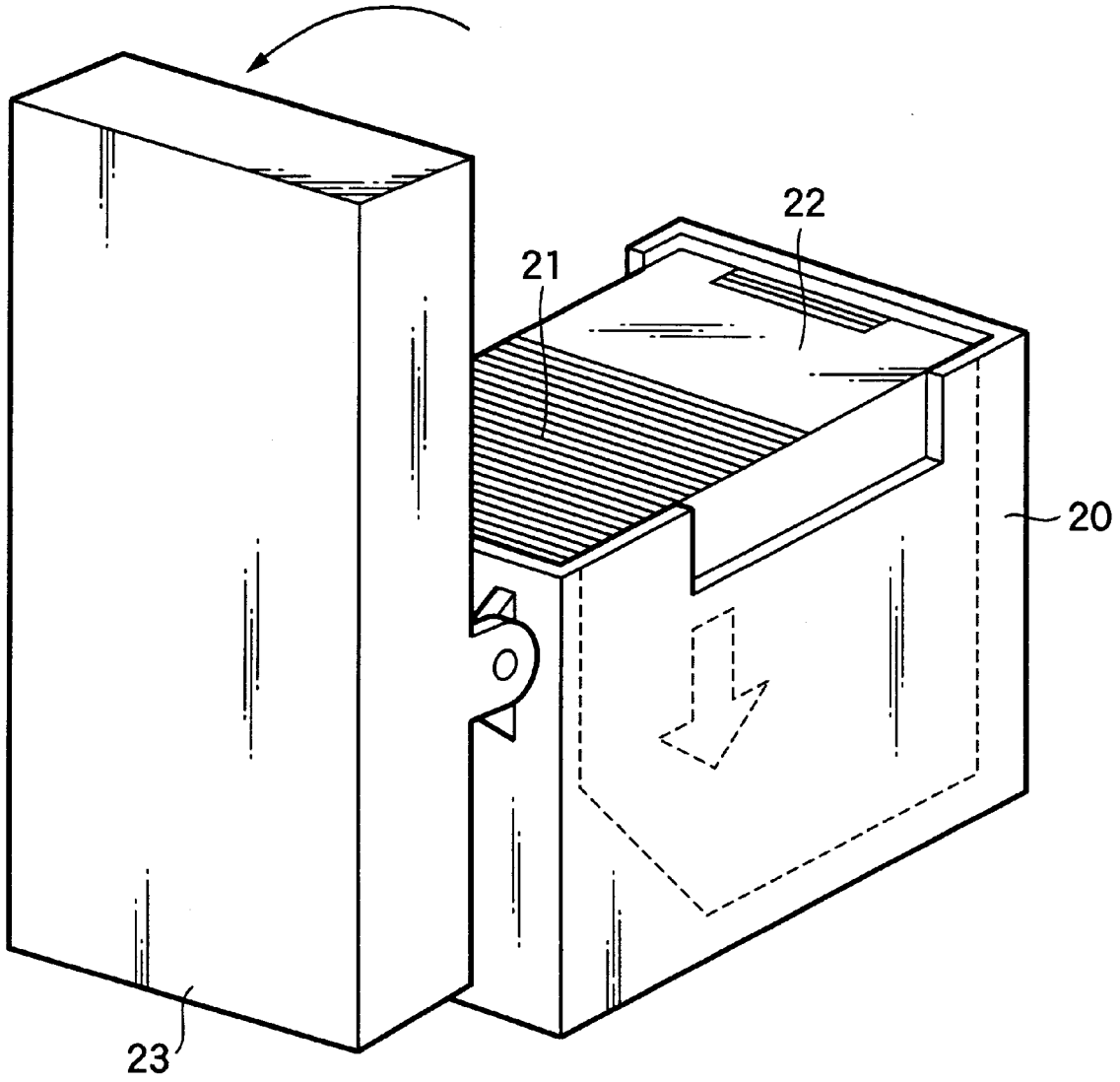
FIG. 5 is a perspective view of a conventional cartridge.

In the cover body 2, as shown in FIG. 4, there is formed a feed passage 14 which is used to guide the feeding of a sheet of sheet-like staple 4 and, when the cover body 2 closes the storage portion 1, the rear-end opening of the feed passage 14 is formed so as to face the uppermost-stage sheet-like staple 4*a* of the sheet-like staples 4 stored in the storage portion 1. Therefore, the uppermost-stage sheet-like staple 4*a* can be transferred from the staple storage portion 1 to the feed passage 14 and can be then fed forwardly.

A portion of the cover body 2 is opened and, when the cartridge is mounted in the electric stapler main body, a feed pawl (not shown) of a feed mechanism disposed on the electric stapler main body side can be inserted through the opened portion of the cover body 2 and can be engaged with the sheet-like staples 4 stored within the refill 3, so that the sheet-like staples 4 can be fed forwardly little by little due to the reciprocating motion of the feed pawl.

Next, at the front end of the feed passage 14, there is disposed a face plate 15 and, on the back side of the face plate 15, there is formed a drive portion 16; and, the sheet-like staples 4 stored in the storage portion 1 are supplied from the feed passage 14 to the drive portion 16 by the above-mentioned feed pawl. Although not shown, in the electric stapler main body, there are disposed a driver plate and a forming plate in such a manner that they are superimposed back and forth on top of each other; and, a staple member existing at the front end of a sheet-like staple 4 is formed into a gate-shaped staple by the forming plate. The thus formed staple is next fed to the drive portion 16 of the face plate and is then driven by the driver plate into a member to be stitched. After then, the leg portions of the staple penetrated through the member to be stitched are bent, which completes the stitching operation.

According to the above-structured cover mechanism, after the refill 3 is inserted into the cartridge, the cover body 2 is mounted. In this operation, as shown in FIGS. 1 and 2(*a*), the securing openings 13 of the covering portion 12 of the cover body 2 are respectively secured to the securing jaws 10 of the movable walls 7. Since the refill 3 is stored within the storage portion 1 and the end portions of the sheet-like staples 4 within the refill 3 are respectively positioned in the vicinity of the inner surfaces of the movable walls 7, while the sheet-like staples 4 remain within the storage portion 1, the sheet-like staples 4 remaining within the storage portion 1 prevent the movable wall 7 from falling down inwardly. This prevents removal of the secured state of the movable walls 7 with respect to the covering portions 12 of the cover body 2, which makes it impossible to remove the cover body 2.

On the other hand, when an operation to drive the staples is carried out sufficiently and thus the sheet-like staples 4 are consumed up with no sheet-like staple 4 being left within the storage portion 1, as shown in FIG. 2(*b*), because there exists no sheet-like staple 4 which prevents the movable walls 7 from swinging inwardly, the operator can insert his or her fingers through the securing openings 13 of the covering portions 12 to thereby be able to push down the movable walls 7 inwardly of the storage portion 1 using the fingers. Owing to this, the secured state of the movable walls 7 with respect to the covering portions 12 of the cover body 2 can be removed and, therefore, the cover body 2 can be removed and a new refill 3 can be inserted into the cartridge.

As described above, even in case where the operator removes the cartridge when the sheet-like staples 4 still remain within the storage portion 1 and, under an illusion that no sheet-like staple 4 is left there, tries to replace the refill 3 with a new one, the cover body 2 cannot be removed, which makes it possible for the operator to recognize easily that one or more sheet-like staples 4 still remain within the storage portion 1. On the other hand, when no sheet-like staple 4 remains within the storage portion 1, the cover body 2 can be opened, which makes it possible for the operator to recognize that a new refill 3 can be inserted into the cartridge. In this manner, since the opening of the storage portion 1 is covered with the cover body 2 and thus the sheet staples 4 are not exposed to the outside, there is no possibility that a person can touch the sheet-like staples 4. The cover body 2 can be opened only when the refill 3 must be replaced with a new one. This can prevent the wrong timing of the refill 3 replacement. Further, the staples and refill 3 can be prevented against damage.

In the above-mentioned embodiment, there is shown a structure in which the opening is formed so as to be opened upwardly. However, in fact, there is also a case in which a cartridge is set in the electric stapler main body in such a manner that its opening can be opened downwardly. In this case as well, the structure and effect of a cover mechanism are the same as the above-mentioned embodiment.

Moreover, the structure of the securing mechanism for securing the covering portions 12 of the cover body 2 to the movable walls 7 is not limited to the above-mentioned structure (securing openings 13 and securing jaws 10). For example, of course, there can also be employed a structure in which the securing jaws are formed in the covering portions 12 and the securing openings are formed in the movable walls 7. Furthermore, the structure of the movable walls is not limited to the above-mentioned structure in which the upper portions thereof can be swung inwardly and outwardly with the lower end portions thereof as the swing centers thereof. For example, there can also be employed a structure in which, with one side of each of the movable walls as the swing center thereof, the other side of each movable wall can be swung inwardly.

What is claimed is:

1. A cover mechanism in a cartridge for an electric stapler, the cartridge including a storage portion for storing piled-up sheet-like staples each having linear-shaped staples connected together in a sheet shape, said cover mechanism comprising:

a movable wall formed on a side wall of the storage portion and capable of swinging inwardly and outwardly;

a cover body disposed over an opening of the storage portion for insertion of the sheet-like staples, said cover body including a covering portion covering an outside portion of said movable wall and respectively formed on two sides of said cover body; and securing mechanism securing together the covering portion of said cover body and said movable wall, wherein secured state between the covering portion of said cover body and said movable wall is removed when any sheet-like staples do not remain within the storage portion.

2. The cover mechanism according to claim 1, wherein said movable wall is fallen down inwardly of the storage portion whereby the secured state between the covering portion of said cover body and said movable wall is removed.

3. The cover mechanism according to claim 1, wherein said securing mechanism includes:

an engaging jaw on said movable wall; and a securing opening in the covering portion of said cover body.

4. The cover mechanism according to claim 1, wherein said securing mechanism includes:

an engaging jaw on the covering portion of said cover body; and a securing opening in said movable wall.

5. The cover mechanism according to claim 1, wherein a lower end portion of said movable wall is a hinge integrally formed with the storage portion.

6. A cartridge for an electric stapler comprising:

a storage portion for storing piled-up sheet-like staples each including linear-shaped staples connected together in a sheet shape, said storage portion including a movable wall capable of swinging inwardly and outwardly on a side wall thereof;

a cover body disposed over an opening of said storage portion for insertion of the sheet-like staples, said cover body including a covering portion covering an outside portion of the movable wall of said storage portion and respectively formed on two sides of said cover body; and securing mechanism securing together the covering portion of said cover body and the movable wall of said storage portion, wherein secured state between the covering portion of said cover body and the movable wall of said storage portion is removed when any sheet-like staples do not remain within said storage portion.

7. The cartridge for an electric stapler according to claim 6, wherein the movable wall of said storage portion is fallen down inwardly of said storage portion whereby the secured state between the covering portion of said cover body and the movable wall is removed.

8. The cartridge for an electric stapler according to claim 6, wherein said securing mechanism includes:

an engaging jaw on the movable wall of said storage portion; and a securing opening in the covering portion of said cover body.

9. The cartridge for an electric stapler according to claim 6, wherein said securing mechanism includes:

an engaging jaw on the covering portion of said cover body; and a securing opening in the movable wall of said storage portion.

10. The cartridge according to claim 6, wherein a lower end portion of the movable wall of said storage portion is a hinge integrally formed with the storage portion.

* * * * *